US011031715B2

(12) United States Patent
Pollmann et al.

(10) Patent No.: US 11,031,715 B2
(45) Date of Patent: Jun. 8, 2021

(54) CONNECTION TERMINAL HAVING A REDUCED SIZE

(71) Applicant: Phoenix Contact GmbH & Co. KG, Blomberg (DE)

(72) Inventors: Carsten Pollmann, Steinheim (DE); Michael Reineke, Steinheim (DE); Peter Klimala, Paderborn (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 239 days.

(21) Appl. No.: 16/305,068

(22) PCT Filed: May 30, 2017

(86) PCT No.: PCT/EP2017/062973
§ 371 (c)(1),
(2) Date: Nov. 28, 2018

(87) PCT Pub. No.: WO2017/207530
PCT Pub. Date: Dec. 7, 2017

(65) Prior Publication Data

US 2020/0373699 A1 Nov. 26, 2020

(30) Foreign Application Priority Data

Jun. 1, 2016 (LU) ..... 93095

(51) Int. Cl.
*H01R 13/187* (2006.01)
*H01R 13/422* (2006.01)
(Continued)

(52) U.S. Cl.
CPC ..... *H01R 13/187* (2013.01); *H01R 9/2616* (2013.01); *H01R 13/4226* (2013.01); *H01R 13/5829* (2013.01)

(58) Field of Classification Search
CPC ..... H01R 4/48; H01R 9/24; H01R 9/2416; H01R 9/26; H01R 9/2616; H01R 13/187; H01R 13/4226; H01R 13/5829
See application file for complete search history.

(56) References Cited

U.S. PATENT DOCUMENTS 5,022,873 A * 6/1991 Kollmann ..... H01R 9/2691 439/716
6,916,214 B2 * 7/2005 Conrad ..... H01R 9/2608 439/716

(Continued)

FOREIGN PATENT DOCUMENTS

DE 102008014177 A1 9/2009
JP 2004103263 A 4/2004

*Primary Examiner* — Renee S Luebke
*Assistant Examiner* — Milagros Jeancharles
(74) *Attorney, Agent, or Firm* — Leydig, Voit & Mayer, Ltd.

(57) ABSTRACT

A connection terminal for connecting at least one electrical conductor includes: a housing; a first connection space formed in the housing; a second connection space formed in the housing; a first busbar piece arranged in the first connection space; a second busbar piece arranged in the second connection space; a first torsion spring which is arranged in the first connection space and has a clamping limb and a retaining limb; and a second torsion spring which is arranged in the second connection space and has a clamping limb and a retaining limb. The first connection space and the second connection space adjoin one another. The first torsion spring is arranged in the first connection space and the second torsion spring is arranged in the second connection space such that the retaining limb of the first torsion spring is supported by the retaining limb of the second torsion spring.

4 Claims, 1 Drawing Sheet

(51) Int. Cl.
*H01R 13/58* (2006.01)
*H01R 9/26* (2006.01)

(56) References Cited

U.S. PATENT DOCUMENTS

| | | | | |
|---|---|---|---|---|
| 7,815,463 | B2 * | 10/2010 | Gerberding | H01R 9/2483 439/441 |
| 10,062,976 | B2 * | 8/2018 | Hoppe | H01R 13/66 |
| 10,355,377 | B2 * | 7/2019 | Gerving | H01R 13/514 |
| 2011/0059658 | A1 | 3/2011 | Eisert et al. | |
| 2014/0127932 | A1 * | 5/2014 | Hoppmann | H01R 4/4827 439/370 |
| 2016/0211591 | A1 * | 7/2016 | Herrmann | H01R 4/4845 |

* cited by examiner

CONNECTION TERMINAL HAVING A REDUCED SIZE

CROSS-REFERENCE TO PRIOR APPLICATIONS

This application is a U.S. National Phase application under 35 U.S.C. § 371 of International Application No. PCT/EP2017/062973, filed on May 30, 2017, and claims benefit to Luxembourg Patent Application No. LU93095, filed on Jun. 1, 2016. The International Application was published in German on Dec. 7, 2017 as WO 2017/207530 under PCT Article 21(2).

FIELD

The invention relates to a connection terminal for connecting at least one electrical conductor, comprising a housing, a first connection space formed in the housing, a second connection space formed in the housing, a first busbar piece arranged in the first connection space, a second busbar piece arranged in the second connection space, a first torsion spring which is arranged in the first connection space and has a clamping limb and a retaining limb, and a second torsion spring which is arranged in the second connection space and has a clamping limb and a retaining limb.

BACKGROUND

From DE 10 2008 014 177 A1, for example, a connection terminal in the form of a series terminal is known which has two connection spaces, in each of which a torsion spring is arranged for clamping a conductor to be connected against a busbar piece. The connection spaces are arranged so as to be spaced apart from one another, and therefore the length of the entire connection terminal is relatively large.

SUMMARY

In an embodiment, the present invention provides a connection terminal for connecting at least one electrical conductor, comprising: a housing; a first connection space formed in the housing; a second connection space formed in the housing; a first busbar piece arranged in the first connection space; a second busbar piece arranged in the second connection space; a first torsion spring which is arranged in the first connection space and has a clamping limb and a retaining limb; and a second torsion spring which is arranged in the second connection space and has a clamping limb and a retaining limb, wherein the first connection space and the second connection space adjoin one another, and wherein the first torsion spring is arranged in the first connection space and the second torsion spring is arranged in the second connection space such that the retaining limb of the first torsion spring is supported by the retaining limb of the second torsion spring.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
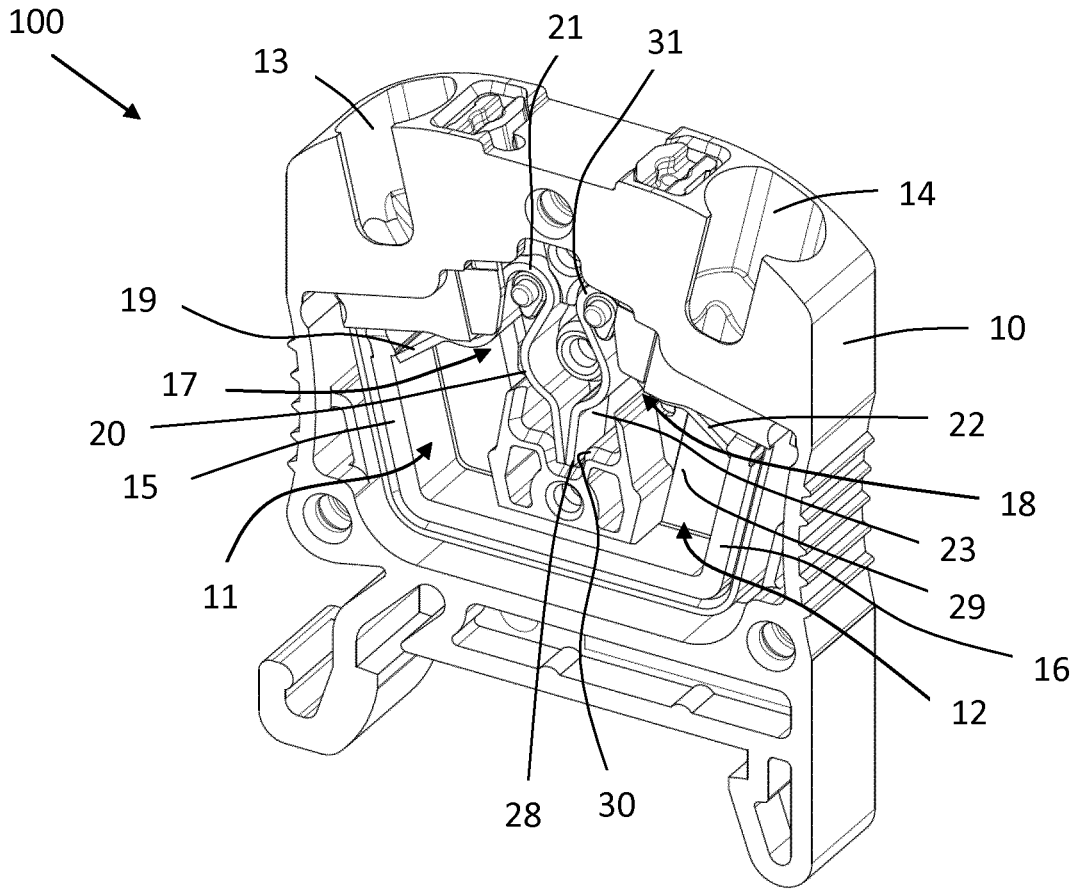
FIG. 1 is a schematic view of a connection terminal according to an embodiment of the invention.

An aspect of the present invention provides a connection terminal which is characterized by a reduced size.

The connection terminal according to the invention is characterized in that the first connection space and the second connection space adjoin one another, and in that the first torsion spring is arranged in the first connection space and the second torsion spring is arranged in the second connection space in such a way that the retaining limb of the first torsion spring is supported by the retaining limb of the second torsion spring.

The two connection spaces adjoining one another makes it possible for the length of the connection terminal to be reduced, as a result of which the whole connection terminal can be made much more compact. In this case, the connection spaces adjoin one another in such a way that they merge into one another. In this case, the connection spaces can be designed to be open with respect to one another at least in regions or in portions. This makes it possible for the first torsion spring arranged in the first connection space and the second torsion spring arranged in the second connection space to be arranged directly next to one another or adjacent to one another. In this case, the two torsion springs are arranged with respect to one another in such a way that they are supported against one another by the retaining limb of the first torsion spring being supported by the retaining limb of the second torsion spring. Thus, in the solution according to the invention, the torsion springs are not supported, as is otherwise conventional, by their retaining limbs on a wall of the housing or a tab bent out of a busbar piece, but on the contrary, they are mounted against one another and thus support one another. This makes it possible to achieve an even more compact design of the entire connection terminal. The torsion springs supporting one another allows said springs to mutually absorb their reaction forces, so that the force of the first torsion spring can act on the second torsion spring and the force of the second torsion spring can act on the first torsion spring. In this case, the two torsion springs are designed to be separate from one another such that the two torsion springs are provided as two individual parts. The torsion springs are thus not rigidly coupled to one another, but the torsion springs are, in particular in the region of their retaining limbs, movable relative to one another. This mobility of the torsion springs relative to one another allows for optimized force distribution and force absorption to be achieved between the two torsion springs.

In order for the retaining limb of the first torsion spring to be supported by the retaining limb of the second torsion spring, it is preferably provided that an edge region of a free end of the first torsion spring abuts an edge region of a free end of the second torsion spring. The two torsion springs thus abut one another preferably only at a very small region, as a result of which compensation between the reaction forces of the two torsion springs can be increased, however. In this case, the retaining limbs of the two torsion springs are preferably arranged with respect to one another at an angle of $2° \leq \alpha \leq 15°$, preferably at an angle of $5° \leq \alpha \leq 10°$. The retaining limbs of the torsion springs thus preferably do not abut one another flatly, but in a punctiform manner. The retaining limbs of the torsion springs are thus preferably positioned so as to be set against one another.

In order to be able to increase the stability of the positioning of the torsion springs in the housing, it is preferably provided that a receiving space is formed in the housing, into which space the retaining limb of the first torsion spring and the retaining limb of the second torsion spring can protrude. The receiving space is preferably formed by a contour which is molded, in particular embossed, into the wall of the housing. The receiving space is preferably formed in the region of the free ends of the retaining limbs of the torsion springs so that the receiving space can surround the free ends of the retaining limbs. The receiving space can thus limit the freedom of movement of the retaining limbs in the longitudinal direction of the connection terminal and thus vertically with respect to the longitudinal direction of the retaining limbs, as a result of which a stabilizing effect can be achieved on the retaining limbs and thus on the two torsion springs. If for example a conductor is inserted and connected only in one of the two connection spaces, or for example conductors having different cross sections are inserted and connected in the two connection spaces, the receiving space or a wall of the receiving space can serve as a kind of stop for the more strongly deflected or loaded torsion spring. This makes it possible to limit the freedom of movement of the more heavily loaded torsion spring, as result of which it can be achieved that the forces on the connected conductor can drop as little as possible or not at all, and the conductor can be safely connected as result.

The receiving space is preferably trough-shaped. Due to the trough-shaped design, the receiving space can surround the free ends of the retaining limbs substantially in a U-shape.

In order to be able to further reduce the installation space of the connection terminal and also in order to be able to reduce the number of parts to be mounted in the connection terminal, the first busbar piece and the second busbar piece can be formed integrally with one another. The two connection spaces can then also be designed to be open with respect to one another in the region of the busbar pieces.

FIG. 1 shows a connection terminal 100 for connecting electrical conductors. The connection terminal 100 shown here is designed as a series terminal which can be snapped onto a support rail.

The connection terminal 100 has a housing 10, in particular made of a plastics material, in which a first connection space 11 for connecting a first conductor and a second connection space 12 for connecting a second conductor are formed. The two connection spaces 11, 12 are arranged directly adjacent to one another, and thus adjoin one another. The two connection spaces 11, 12 are designed to be open with respect to one another, in regions, such that the connection spaces 11, 12 merge into one another In order to insert a first conductor into the first connection space 11, the housing 10 has a first conductor inserting opening 13. In order to insert a second conductor into the second connection space 12, the housing 10 has a second conductor inserting opening 14.

A first busbar piece 15 is arranged in the first connection space 11, and a second busbar piece 16 is arranged in the second connection space 12, the first busbar piece 15 and the second busbar piece 16 being integral.

Further, a first torsion spring 17 is arranged in the first connection space 11 for connecting and clamping a conductor inserted into the first connection space 11 against the first busbar piece 15.

A second torsion spring 18 is arranged in a second connection space 12 for connecting and clamping a conductor inserted into the second connection space 12 against the second busbar piece 16. The first torsion spring 17 has a clamping limb 19 for clamping an inserted conductor against the first busbar piece 15, and a retaining limb 20, the clamping limb 19 and the retaining limb 20 being integrally connected to one another by means of an arcuate portion 21. The second torsion spring 18 also has a clamping limb 22 for clamping an inserted conductor against the second busbar piece 16, and a retaining limb 23, the clamping limb 22 and the retaining limb 23 being integrally connected to one another by means of an arcuate portion 31.

The two torsion springs 17, 18 are arranged mirror-symmetrically to one another, so that the retaining limbs 20, 23 of the two torsion springs 17, 18 are arranged opposite or directly adjacent to one another. On the other hand, the clamping limbs 19, 22 of the torsion springs 17, 18 are directed away from one another.

Figure 2:
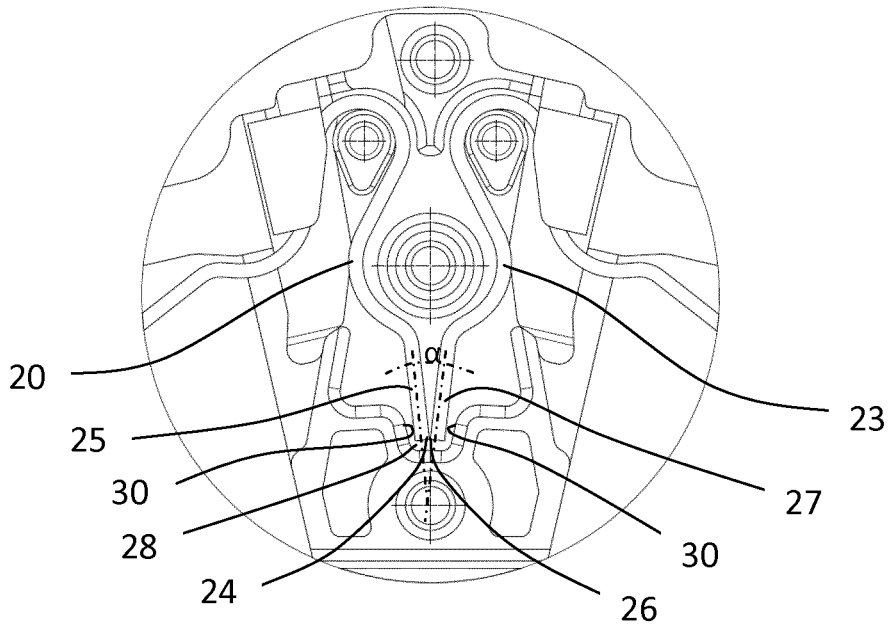
FIG. 2 is a schematic view of a detail of the connection terminal shown in FIG. 1.

In this case, the retaining limbs 20, 23 of the torsion springs 17, 18 are arranged adjacent to one another in such a way that the retaining limb 20 of the first torsion spring 17 is supported by the retaining limb 23 of the second torsion spring 18. This can also be seen in particular in the detail in FIG. 2.

The retaining limbs 20, 23 support one another at a free end 25, 27 of the two retaining limbs 20, 23, the free ends 25, 27 being remote from the arcuate portions 21, 31 of the torsion springs 17, 18. The retaining limbs 20, 23 thus do not support one another over the entire length of the retaining limbs 20, 23, but only at a small portion of the retaining limbs 20, 23. The two retaining limbs 20, 23 do not abut one another flatly, but the abutment is substantially punctiform in that an edge region 24 of the free end 25 of the retaining limb 20 of the first torsion spring 17 abuts an edge region 26 of a free end 27 of the retaining limb 23 of the second torsion spring 18. The retaining limbs 20, 23 of the two torsion springs 17, 18 are arranged with respect to one another at an angle of $2° \leq \alpha \leq 15°$, so that the two retaining limbs 20, 23 are positioned so as to be set against one another. The edge regions 24, 26, at which the retaining limbs 20, 23 abut one another, extend transversely to the longitudinal direction or longitudinal extension of the retaining limbs 20, 23.

To increase the stability of the two abutting retaining limbs 20, 23 of the torsion springs 17, 18, a receiving space 28 is formed in the housing 10, into which space the two retaining limbs 20, 23 protrude by their free ends 25, 27. The receiving space 28 is formed by a contour that is molded or embossed into the housing 10 and that protrudes from a rear wall 29 of the housing 10 into an inner space of the housing 10. The receiving space 28 has a wall 30 which, in its width, corresponds approximately to the width of the retaining limbs 20, 23 of the torsion springs 17, 18. The wall 30 and thus the receiving space 28 are substantially U-shaped, so that the receiving space 28 surrounds the free ends 25, 27 of the retaining limbs 20, 23. When the retaining limbs 20, 23 are deflected, the wall 30 of the receiving space 28 can thus serve as a kind of stop or stop surface in order to be able to limit the movement of the retaining limbs 20, 23 transversely to their longitudinal extension. The receiving space 28 has a trough-shaped design.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

| LIST OF REFERENCE NUMERALS | |
|---|---|
| Connection terminal | 100 |
| Housing | 10 |
| First connection space | 11 |
| Second connection space | 12 |
| First conductor insertion opening | 13 |
| Second conductor insertion opening | 14 |
| First busbar piece | 15 |
| Second busbar piece | 16 |
| First torsion spring | 17 |
| Second torsion spring | 18 |
| Clamping limb | 19 |
| Retaining limb | 20 |
| Arcuate portion | 21 |
| Clamping limb | 22 |
| Retaining limb | 23 |
| Edge region | 24 |
| Free end | 25 |
| Edge region | 26 |
| Free end | 27 |
| Receiving space | 28 |
| Rear wall | 29 |

-continued

| LIST OF REFERENCE NUMERALS | |
|---|---|
| Wall | 30 |
| Arcuate portion | 31 |

The invention claimed is:

1. A connection terminal for connecting at least one electrical conductor, comprising:

a housing;

a first connection space formed in the housing;

a second connection space formed in the housing;

a first busbar piece arranged in the first connection space;

a second busbar piece arranged in the second connection space;

a first torsion spring which is arranged in the first connection space and has a clamping limb and a retaining limb; and a second torsion spring which is arranged in the second connection space and has a clamping limb and a retaining limb, wherein the first connection space and the second connection space adjoin one another, wherein the first torsion spring is arranged in the first connection space and the second torsion spring is arranged in the second connection space such that the retaining limb of the first torsion spring is supported by the retaining limb of the second torsion spring, and wherein, in order for the retaining limb of the first torsion spring to be supported by the retaining limb of the second torsion spring, an edge region of a free end of the first torsion spring abuts an edge region of a free end of the second torsion spring.

2. The connection terminal according to claim 1, wherein a receiving space is formed in the housing, into which space the retaining limb of the first torsion spring and the retaining limb of the second torsion spring protrude.

3. The connection terminal according to claim 2, wherein the receiving space is trough-shaped.

4. The connection terminal according to claim 1, wherein the first busbar piece and the second busbar piece are integral with one another.

* * * * *